United States Patent [19]

Nelson et al.

[11] 4,051,063

[45] Sept. 27, 1977

[54] STORAGE OF MATERIAL

[75] Inventors: Richard Stuart Nelson, Goring-on-Thames; Stanley Frederick Pugh, Abingdon; Michael John Stapley Smith, Boars Hill, all of England

[73] Assignee: United Kingdom Atomic Energy Authority, London, England

[21] Appl. No.: 524,996

[22] Filed: Nov. 18, 1974

[30] Foreign Application Priority Data

Nov. 20, 1973 United Kingdom ..... 53893/73

[51] Int. Cl.[2] ..... G21F 9/02

[52] U.S. Cl. ..... 252/301.1 W; 204/192 N

[58] Field of Search ..... 252/301.1 W; 204/298, 204/192

[56] References Cited

U.S. PATENT DOCUMENTS

| | | | |
|---|---|---|---|
| 3,141,989 | 7/1964 | Jones et al. | 204/298 |
| 3,294,669 | 12/1966 | Theuerer | 204/298 |
| 3,326,178 | 6/1967 | Angelis | 252/361.1 R |
| 3,486,935 | 12/1969 | Eyrich | 204/192 |
| 3,617,459 | 11/1971 | Logan | 204/298 |
| 3,644,191 | 2/1972 | Matsushima | 204/298 |
| 3,654,110 | 4/1972 | Kraus | 204/298 |
| 3,691,053 | 9/1972 | James et al. | 204/298 |
| 3,716,472 | 2/1973 | Kausche | 204/298 |

*Primary Examiner*—Brooks H. Hunt
*Assistant Examiner*—Deborah L. Kyle
*Attorney, Agent, or Firm*—Larson, Taylor and Hinds

[57] ABSTRACT

There is disclosed a method for the convenient storage of material, especially noxious or radioactive material, which method comprises entrapping the material within a solid by bombarding the solid with ions of the material so as to form a concentration of the material within the solid.

Forms of apparatus for carrying out this method are also described.

17 Claims, 5 Drawing Figures

STORAGE OF MATERIAL

The present invention relates to the storage of material and finds a particular application in the storage of noxious or radioactive material.

The present invention provides a method for the convenient storage of material, especially noxious or radioactive material, which method comprises entrapping the material within a solid by bombarding the solid with ions of the material so as to form a concentration of the material within the solid.

In one method according to the invention the bombarding is carried out at an energy sufficient to implant the material beneath the surface of the solid and erosion of the said solid, due to sputtering, is controlled such that the material is not prevented from being retained therein.

Sputtering can be utilised to build up the solid simultaneously with the implantation of the material to be entrapped so that there is a net gain in the thickness of the solid.

Alternatively, implantation of the material to be entrapped and build up of the solid using sputtering is carried out alternately.

Other methods may be used to build up the solid, for example, vapour deposition.

It is believed that the solid can be chosen from a wide range of metallic or ceramic substances. It is thought that metals and alloys offer the properties most suitable for use in the present invention. For example, the use of refractory metals offers the advantage of high temperature stability.

One application of the present invention, given by way of example, is in the storage of radioactive gases which are obtained during the reprocessing of nuclear fuels. A particular problem in such reprocessing is the release of krypton gas trapped in irradiated fuel. About 7 to 8% of the krypton gas obtained during reprocessing is in the form of the isotope krypton-85.

Since the krypton-85 isotope has a half life of about 10 years storage methods for krypton gas containing this isotope must offer safe containment of the gas for 100 to 200 years.

Storing the gas under pressure in conventional gas cylinders for such periods is subject to the risk of cylinder corrosion and subsequent radioactive gas release.

Low pressure storage is inconvenient due to the size of vessel that would be required.

According to the present invention krypton containing the isotope krypton-85 is entrapped within a solid, for example nickel metal or copper metal, by bombarding the solid with krypton ions so as to produce krypton bubbles within the solid.

In one embodiment of the invention sputtering is utilised to build up the solid.

Bubble size is related to temperature, but typically bubble diameter will be in the region of a few hundred Angstroms.

The bubbles would be stable at least up to the temperature at which they were formed. Thus, if the bombarding of the solid with krypton ions was carried out at elevated temperature (e.g. 500° C), the temperature at which release would occur would be well above ambient storage temperatures.

Bombarding the solid at elevated temperatures is therefore believed to provide a means for entrapping gas such that the risk of release is reduced if the solid is accidentally subjected to heat during storage, as for example during a fire.

In principle, the present invention is applicable to the entrapping of a wide range of materials for storage. Thus, in addition to krypton, it is believed for example, that xenon, helium and tritium could be conveniently entrapped.

In fact, xenon and krypton are produced together during nuclear fuel reprocessing. However, since xenon has a short half life and commercial value, it would be separated from a krypton/xenon mixture prior to the storage of the krypton.

In carrying out the present invention to entrap light materials such as helium and tritium it is necessary to take into account that whilst light materials can be implanted readily, sputtering by light materials is small. Thus to enable sputtering to be utilized to build up the solid a further gaseous material, such as argon, which can be used to give sputtering, is included with the light material to be implanted.

It is believed that up to about 340 liters of krypton a STP could be stored in 1000 cc (8.9 kg) of nickel in accordance with the present invention. Using a conventional gas cylinder storage technique only about 170 liters of krypton at STP per liter gas space could be achieved at a cylinder pressure of about 2,200 p.s.i.

Use of a metal to entrap krypton has the advantage that radioactive decay heat during storage would be dissipated.

Once the gas has been entrapped in the solid, the solid itself could be encapsulated to reduce further the risk of release during prolonged storage.

The present invention also provides apparatus for use in entrapping a material to be stored within a solid by bombarding the solid with ions of the material so as to form a concentration of the material within the solid, comprising a pair of electrodes forming part of a discharge system and means for maintaining about the electrodes an atmosphere containing material to be stored, the arrangement being such that the electrodes can be so energised from an electrical supply that ions of the material to be stored can be implanted and the material thereby entrapped in the solid.

One electrode can form the solid within which the material to be stored is entrapped.

In one embodiment the apparatus can be in combination with an electrical supply which is controllable so as to build up one of the electrodes by sputtering from the other electrode.

U.S. application Ser. No. 524,995, filed Nov. 18, 1974, corresponding to British Pat. application No. 47792/74 discloses inter alia apparatus for use in entrapping a material to be stored within a solid by bombarding the solid with ions of the material so as to form a concentration of the material within the solid, comprising a sealable container for enclosing an atmosphere containing material to be stored and adapted to provide one electrode of a discharge system and an electrode within the container adapted to form a second electrode of a discharge system, the arrangement being such that the electrodes can be so energised from an electrical supply that ions of the material to be stored can be implanted and the material thereby entrapped in a wall of the sealable container.

It will be appreciated that to avoid the necessity of constructing the whole container from a solid capable of entrapping material a lining of such solid could be provided inside a container of another solid.

Apparatus for carrying out the method of the present invention will now be described by way of example with reference to the accompanying drawings, in which.

Figure 2:
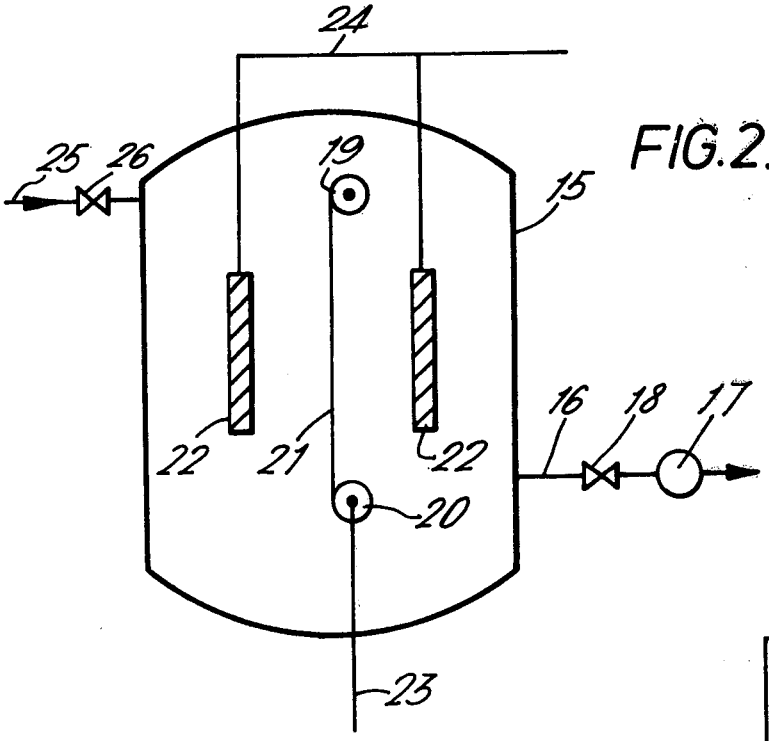
FIG. 2 shows a diagrammatic representation of an apparatus for implanting a material into a sheet or film of a solid.
Figure 3:
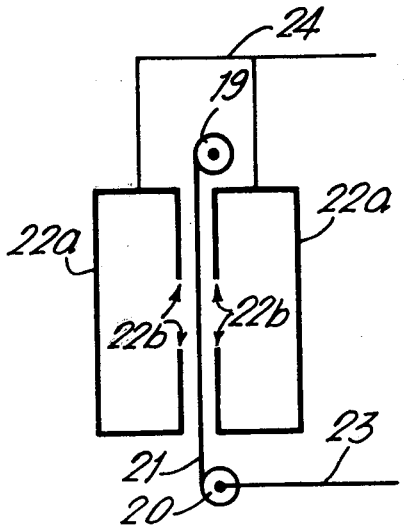
FIG. 3 shows, in diagrammatic form, one form of electrode for use in the apparatus of FIG. 2.

In FIGS. 2 and 3 like reference numerals refer to like components.

Figure 1:
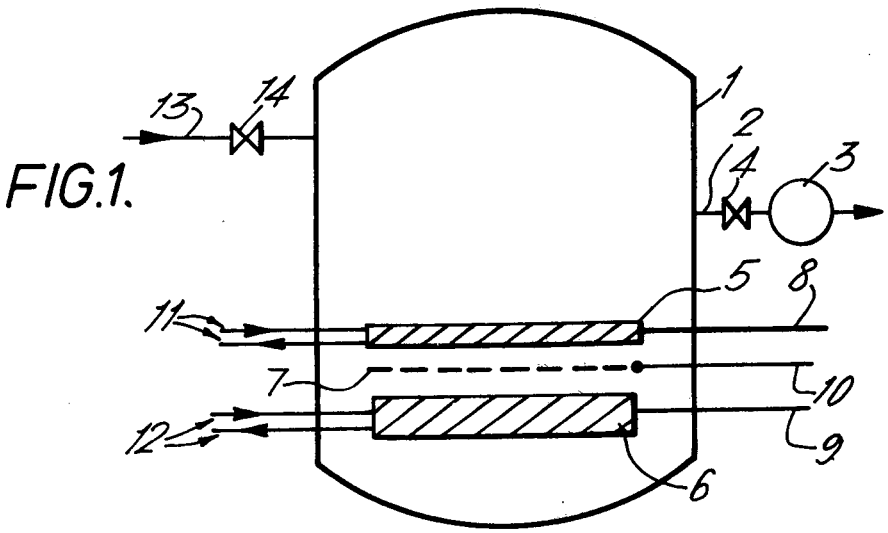
FIG. 1 shows a diagrammatic representation of an apparatus for implanting a material into a solid and building up the solid by sputtering.

Referring now to FIG. 1 of the drawings, a sealable chamber 1 is provided with a pipe 2 connected to a vacuum system 3 via a valve 4. Within the chamber 1 there are supported two solid electrodes 5 and 6, composed of a solid capable of entrapping a gaseous material, and a permeable electrode 7. The electrodes 5, 6 and 7 are respectively connected to an electrical supply (not shown) through conductors represented respectively as 8, 9 and 10.

To dissipate heat generated when the apparatus is in operation, the electrodes 5 and 6 are provided with means for recirculating a coolant medium therethrough, represented respectively by 11 and 12.

A pipe 13 having a control valve 14 is provided for the introduction of a gaseous material into the chamber 1.

In operation the chamber 1 is first evacuated to a pressure of about 100 microns by means of the pipe 2, the vacuum system 3, and the valve 4.

Subsequently the gaseous material to be implanted and thereby entrapped in a solid, e.g., krypton containing the isotope krypton 85 is introduced into the chamber 1 by means of pipe 13 and valve 14 so as to surround the electrodes 5, 6 and 7. Valve 14 may be controlled automatically by the pressure in the chamber 1 so that gaseous material is introduced to make up for that which is implanted into the solid. It is to be understood that, in some circumstances, it may be necesssary to pump continuously from the chamber 1 in order to maintain the required reduced pressure therein.

By controlled use of an electric supply to the electrodes 5, 6 and 7 an electrical discharge occurs through the gaseous material with the result that gaseous material is implanted into the body of the electrodes 5 and 6 through the surfaces thereof facing the permeable electrode 7.

The implantation of ions into the electrodes 5 and 6 is accompanied by sputtering of the solid material of which they are composed. This would normally result in the surfaces of the electrodes being eroded away until the implanted gaseous material is released. However, by controlling the electrical supply to the electrodes (e.g., so that one electrode receives say, four times the discharge of the other electrode) the surface of the electrode 6 is built up by material sputtered from the electrode 5. This means that electrode 5 performs a "sacrificial" role and is eroded, the gaseous material implanted therein being released to the interior of the chamber 1, whilst electrode 6 both increases in thickness and entraps gaseous material.

The electrical supply can be controlled to give either simultaneous implantation and build up, or to permit alternate implantation and build up. Control of the electrical supply can be, for example, by adjusting the value and/or polarity of potential applied to a particular electrode and/or the time for which potential is applied to a particular electrode in accordance with electrical discharge technology.

The supply of radioactive gas to the chamber 1 can be interrupted and, in the case of a radioactive gas such as krypton containing krypton-85 isotope, an atmosphere of non-radioactive gas (e.g. non-radioactive krypton or argon) can be introduced into the chamber 1. Thus, the electrode 6 can be given a final treatment to provide a non-radioactive krypton layer adjacent to the surface thereof. Non-radioactive krypton or other gas such as argon can be used to sputter material onto the electrode 6 so as to provide a final layer of material containing substantially no gas.

When the electrode 6 has been built up to the desired amount and the desired amount of gaseous material has been entrapped therein the chamber 1 is opened and the electrode 6, now a "storage block" of a solid "matrix" containing gaseous bubbles, removed therefrom for storage, following optional encapsulation.

A solid provided with a non-radioactive gas layer adjacent to the surface thereof is believed to give substantially no release of gaseous material until the melting point of the solid is reached.

The apparatus hereinbefore described may be modified so that the permeable electrode 7 is omitted and the bombarding and sputtering process carried out using only two electrodes (i.e., corresponding to electrodes 5 and 6. In operation, once again, electrode 5 would perform the sacrificial role whilst electrode 6 would be built up.

It is to be understood that in the apparatus hereinbefore described the electrodes are shown diagrammatically and that in practice electrode geometry and electrode shielding would be chosen, in accordance with "glow discharge" technology, to suit particular requirements and to cause the discharge to occur in the desired region.

Calculations have shown that where the two electrodes (5 and 6) are in the form of two plates of nickel each having a surface area of 25 $cm^2$ the net rate of build up of the plate corresponding to electrode 6 can be about 5 mm/day (assuming implantation to give 10 atom % krypton) with an operational voltage of 3 kv at 180 kw. These calculations relate to an apparatus for treating 100 liter/day of gaseous material.

The following electrical current relationship has been used in calculations performed in relation to the present invention:

$$\frac{I_m}{I_t} = \frac{1}{CS} + 1$$

where $I_m$ = current to the electrode providing the solid for build up by sputtering (i.e., the "sacrificial" electrode)

$I_t$ = current to target electrode (i.e. solid built up by sputtering)

$C$ = atomic concentration of krypton in the solid and $S$ = sputtering ratio for the solid (number of atoms ejected per incident ion).

The depth of implantation of material using the apparatus hereinbefore described in dependent on the energy used, but typically could be to a depth of approximately 100° A below the surface of the solid.

As an alternative to simultaneous, or alternate, implanting and building up as described above gaseous material could be implanted into a thin (0.001 inch) sheet or film of a solid (e.g. nickel or copper) to form a layer of gaseous material in the solid. This implantation could be achieved, for example, by the use of a two electrode system under reduced pressure, one electrode being the sheet of solid.

Referring now to FIG. 2 of the drawings a sealable chamber 15 is provided with a pipe 16 connected to a vacuum system 17 via a valve 18.

Within the chamber 15 there are supported two rollers 19 and 20 for carrying a sheet or film 21 of a solid capable of entrapping a gaseous material. Also in the chamber 15 there is supported an electrode system represented as 22.

The rollers 19 and 20 (and hence the sheet or film 21) are electrically connected to an electrical supply (not shown) through an electrical conductor represented as 23. The electrode system 22 is also connected to the electrical supply through an electrical conductor system represented at 24. A pipe 25 having a control valve 26 is provided for the introduction of a gaseous material into the chamber 15.

In operation the chamber 15 is first evacuated to a pressure of about 100 microns by means of the pipe 16, vacuum system 17 and valve 18.

Subsequently the gaseous material to be implanted and thereby entrapped in a solid, e.g., krypton containing the isotope krypton-85 is introduced into the chamber 15 by means of the pipe 25 and valve 26 so as to surround the sheet or film 21 and the electrode system 22. Valve 26 may be controlled automatically by the pressure in the chamber 15 so that gaseous material is introduced to make up for that which is implanted into the solid. It is to be understood that in some circumstances it may be necessary to pump continuously from the chamber 15 in order to maintain the required reduced pressure therein.

By controlled use of an electrical supply to the electrode system 22 and the sheet or film 21 (which constitutes an electrode) through conductor system 24 and conductor 23 respectively an electrical discharge occurs through the gaseous material with the result that gaseous material is implanted into both sides of the sheet or film 21.

It is to be understood that the electrode system 22 could be arranged so that gaseous material would be implanted into only one side of the sheet or film 21 if this was desired.

By use of the rollers 19 and 20 the sheet or film 21 is moved relative to the electrode system 22 so that fresh solid material can be presented for implantation with gaseous material. In this way fresh sheet or film may be unwound from say roller 20, passed adjacent to the electrode system 22 and thereby implanted with gaseous material, and wound onto roller 19.

Depending on the amount of material to be implanted in any one portion of sheet or film, one sheet or film, or one portion thereof, may be passed adjacent to the electrode system 22 several times so as to receive several implantation treatments. It is to be understood that it may be necessary to provide cooling means for removing from the sheet or film the heat generated during operation of the apparatus.

When the desired amount of gaseous material has been entrapped the sheet or film 21 is removed from the chamber 15 for storage following optional encapsulation.

Referring now to FIG. 3 of the drawings, there is shown, in diagrammatic form one particular form of electrode for use as the electrode system 22 of FIG. 2.

The electrodes 22 are shown in the form of chambers **22*a* having apertures 22*b* adjacent to which is positioned the portion of the sheet or film 21** to be implanted.

As described in relation to FIG. 2, the sheet or film 21 is moved by means of the rollers 19 and 20. Similarly, connection to the electrical supply is achieved through conductors represented as 23 and 24.

In operation, glow discharge occurs in the region of the apertures **22*b* and gaseous material is implanted into the sheet or film 21.**

FIGS. 2 and 3 are diagrammatic representations of apparatus, and it is to be understood that in practice electrode geometry and electrode shielding would be chosen, in accordance with glow discharge technology, to cause the discharge to occur in the desired region.

As alternatives to carrying out the present invention using "glow discharge" as hereinbefore described with reference to FIGS. 1, 2 and 3 other ion implantation techniques can be used in accordance with the present invention, e.g., ion guns or electron assisted discharge.

Apparatus for carrying out the present invention by use of an electron supported discharge will now be described with reference to FIG. 4.

Figure 4:
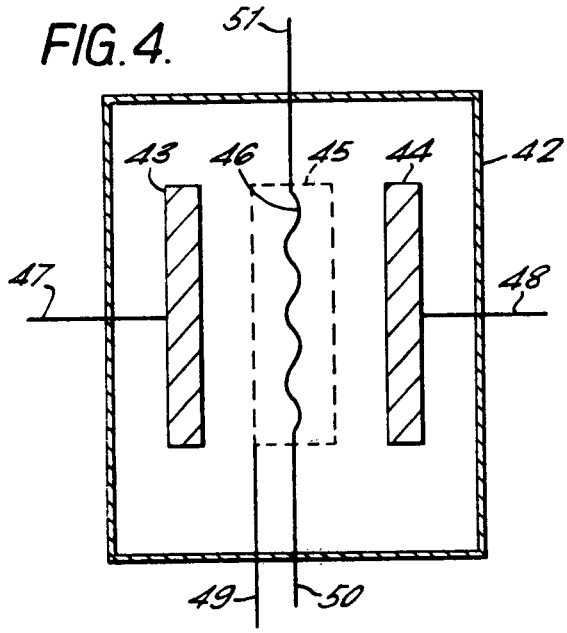
FIG. 4 shows a diagrammatic representation of another apparatus for implanting a material into a solid and building up the solid by sputtering.

Referring now to FIG. 4 of the drawings within a sealable chamber 42 there is provided two solid electrodes 43 and 44, composed of a solid capable of entrapping a gaseous material, a grid 45 between the electrodes 43 and 44, and within the grid 45 a filament 46. The electrodes 43 and 44 are connected to an electrical supply (not shown) through conductors 47 and 48 respectively. The grid 45 is connected to a means (not shown) for applying a potential thereto by conductor 49, and conductors 50 and 51 are provided to enable a heating current to be applied to the filament 46. Also provided are means (not shown) similar to those hereinbefore described in relation to FIG. 1 for evacuating the chamber 42, for the introduction of a gaseous material, and for dissipating from the electrodes 43 and 44 heat generated during operation.

In operation the chamber 42 is evacuated to a pressure of about 10 microns and subsequently gaseous material to be implanted and thereby entrapped in a solid is introduced into the chamber 42 so as to surround the electrodes 43 and 44, the grid 45 and filament 46. Continuous pumping may be required as hereinbefore mentioned.

Electrical current is applied to the filament 46 and an electrical potential is applied to the grid 45 so as to provide a region of electrical discharge or plasma in the vicinity of the grid 45 and filament 46.

A potential is applied to the two electrodes 43 and 44 so that positive ions of material to be entrapped are drawn out of the region of the filament 46 and grid 45 and implanted into the electrodes 43 and 44. It will be appreciated that the material of these electrodes is sputtered by the ion bombardment and that the electrical supply to the electrodes 43 and 44 is controlled as hereinbefore mentioned to build up one electrode, say 44, by material sputtered from the other electrode 43. Filament intensity may also be varied.

The built up electrode having material entrapped therein can subsequently be removed for storage, or the entire chamber removed for storage.

Figure 5:
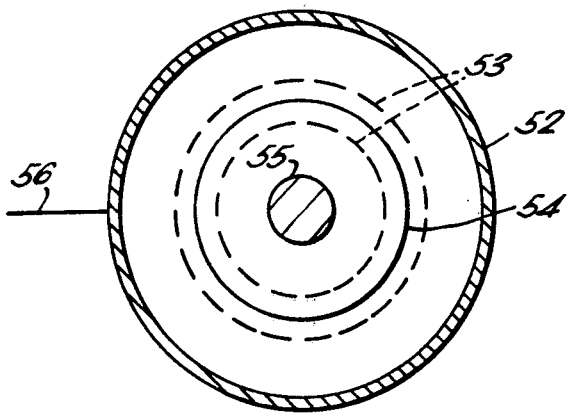
FIG. 5 shows, diagrammatically, a modification of the apparatus of FIG. 4.

Referring now to FIG. 5 of the drawings, there is shown, diagrammatically, an apparatus embodying the principle of the apparatus of FIG. 5 in a concentric configuration.

There is provided a sealable container 52 and, within the container 52, an annular cross-section grid 53 enclosing a cylindrical filament 54, and a central electrode 55. The container 52 is connected by means of a conductor 56 to an electrical supply (not shown) or to form one electrode of a discharge system and electrode 55 is connected to the electrical supply to form a second electrode. Electrical connections (not shown) are also provided to permit a potential to be applied to the grid 53 and an electrical current to the filament 54.

Means (not shown) are also provided as in FIG. 4 for evacuating the container 52, for the introduction of a gaseous material, and for dissipating from the electrodes 52 and 55 heat generated during operation.

Operation of the apparatus of FIG. 5 is essentially similar to that of FIG. 4 except that the container 52 serves as the chamber and one electrode so that gaseous material is implanted into the walls of the sealable container 52 which are built up by sputtering from the electrode 55.

Statements made in relation to FIG. 1 concerning simultaneous implantation and build up, and alternate implantation and build up, and the provision of a non-radioactive layer or a layer containing substantially no gas also apply to the apparatus of FIG. 4 and that of FIG. 5.

It will be appreciated that FIGS. 4 and 5 are diagrammatic representations of apparatus and it is to be understood that in practice electrode geometry and electrode shielding would be chosen in accordance with electron supported discharge technology to suit particular requirements and to cause the discharge to occur in the desired region.

The present invention will now be further described with reference to the following Examples:

EXAMPLE 1

Argon was implanted in accordance with the present invention into solid by glow discharge using two plane nickel electrodes separated by a 16 mm gap.

An electrical supply was used to deliver 4 mA over 1.22 $cm^2$ at 6kV and an atmosphere of argon at a pressure of 100 microns was used to surround the electrodes.

The deposition rate of sputtered nickel was found to be $3.5 \times 10^{-4}$ $gm/cm^2/mA$ hour.

EXAMPLE 2

Argon was implanted in accordance with the present invention into nickel by electron supported discharge using two plane electrodes, a grid and a filament in an arrangement similar to that described in relation to FIG. 4. The electrodes were $5 \times 4$ cm separated by a gap of approximately 5 cm and the filament was inside a cylindrical grid of approximately 1 cm diameter.

An atmosphere of argon at 12 microns pressure was used to surround the electrodes, grid and filament. The discharge within the grid was 125 mA at 50 V and the electrodes were arranged to receive 30 mA at 500 V negative with respect to the grid.

The deposition rate of sputtered nickel was $1.42 \times 10^{-5}$ $gm/cm^2/mA$ hour.

In carrying out the present invention with a ceramic solid an RF discharge would be used to achieve implantation of the material to be stored into the ceramic solid.

We claim:

1. A method for the storage of a material within a solid comprising the steps of:

locating a solid in a chamber containing an atmosphere comprising a material to be stored within the solid;

bombarding a surface of the solid with ions of the material of said atmosphere at an energy sufficient such that the material is implanted beneath the surface of the solid and such that erosion of the solid, due to sputtering, does not prevent the implanted material from being retained in said solid, said bombarding forming a concentration of said material within the solid;

depositing on the implanted surface of said solid, by sputtering, additional solid material such that there is a net gain in the thickness of said solid, said sputtering being carried out in said chamber with ions of said atmosphere including ions of said material to be stored; and bombarding said additional solid material with ions of the material of said atmosphere to implant ions of the material therein such that there is a buildup of stored material in the solid.

2. A method according to claim 1 wherein said material to be stored comprises a radioactive isotope.

3. A method according to claim 1 wherein the step of bombarding with ions is carried out simultaneously with the step of depositing solid by sputtering.

4. A method according to claim 1 wherein the steps of bombarding with ions and depositing solid by sputtering are carried out alternately.

5. A method according to claim 4 wherein said steps of bombarding with ions and depositing solid by sputtering are carried out repeatedly.

6. A method according to claim 1 wherein said step of bombarding with ions is carried out by means of an electrical discharge.

7. A method according to claim 6 wherein said electrical discharge is a glow discharge.

8. A method according to claim 6 wherein said electrical discharge is an electron supported discharge.

9. A method according to claim 1 wherein said material to be stored comprises a radioactive isotope of krypton or zenon.

10. A method according to claim 1 wherein said material comprises tritium or helium.

11. A method according to claim 1 wherein the step of bombarding with ions is carried out at an elevated temperature.

12. A method according to claim 1 wherein the solid comprises a metal.

13. A method according to claim 12 wherein the metal is selected from the group consisting of nickel and copper.

14. A method according to claim 1 including the further step of depositing a layer of solid free of said material to be stored onto the built-up solid.

15. A method according to claim 1 including the further step of encapsulating the solid after implantation of said material to be stored therein.

16. A method according to claim 1 wherein said material to be stored comprises krypton containing the krypton −85 isotope and wherein said step of bombarding with ions of said material to be stored produces bubbles of krypton within the solid.

17. A method for the storage of material within a solid according to claim 31 comprising providing a first and a second electrode of the solid, said first and second electrodes forming part of a discharge system, providing said atmosphere about said first and second electrodes, electrically energizing said first and second electrodes so that ions of the material to be stored bombard a surface of each of the electrodes, and controlling the electrical energizing to implant material beneath the surface of the first electrode to form a concentration of the material within said first electrode and to deposit on the implanted surface of said first electrode new solid sputtered from said second electrode so that there is a net gain in the thickness of, and a build up of stored material, in, said first electrode.

* * * * *

UNITED STATES PATENT AND TRADEMARK OFFICE

CERTIFICATE OF CORRECTION

PATENT NO. : 4,051,063

DATED : September 27, 1977

INVENTOR(S) : Richard Stuart Nelson, Stanley Frederick Pugh and Michael John Stapley Smith It is certified that error appears in the above-identified patent and that said Letters Patent are hereby corrected as shown below:

Claim 10, line 2, after "material", insert --to be stored--.

Claim 10, line 2, after "helium", insert --and wherein said atmosphere contains a material which facilitates sputtering--.

Claim 17, line 2, delete "claim 31" and insert --claim 1--.

Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*